US006331077B1

(12) United States Patent
Nickell

(10) Patent No.: US 6,331,077 B1
(45) Date of Patent: Dec. 18, 2001

(54) BULK BAG FOR DENSE MATERIALS

(75) Inventor: Craig A. Nickell, Sherman, TX (US)

(73) Assignee: Super Sack Mfg. Corp., Dallas, TX (US)

( * ) Notice: Subject to any disclaimer, the term of this patent is extended or adjusted under 35 U.S.C. 154(b) by 0 days.

(21) Appl. No.: 09/479,812

(22) Filed: Jan. 7, 2000

(51) Int. Cl.[7] ..... B65D 33/02
(52) U.S. Cl. ..... 383/119; 383/903; 383/105
(58) Field of Search ..... 383/105, 903, 383/109, 119, 38; 220/9.1, 9.2

(56) References Cited

U.S. PATENT DOCUMENTS

| | | | | |
|---|---|---|---|---|
| 1,338,776 | * | 5/1920 | Jennings | 383/38 |
| 5,071,025 | * | 12/1991 | Boots | 383/119 X |
| 5,076,710 | | 12/1991 | Derby . | |
| 5,222,812 | * | 6/1993 | Cuddy et al. | 383/119 X |
| 5,538,155 | * | 7/1996 | Hoekstra | 383/119 X |
| 6,015,057 | | 1/2000 | Stone et al. . | |

FOREIGN PATENT DOCUMENTS

| | | | | |
|---|---|---|---|---|
| 4021504 | * | 1/1992 | (DE) | 220/9.1 |
| 4044958 | * | 1/1992 | (JP) | 383/38 |
| PCT/IE96/00078 | | 12/1996 | (WO) . | |
| PCT/IE99/00115 | | 11/1999 | (WO) . | |

* cited by examiner

*Primary Examiner*—Allan N. Shoap
*Assistant Examiner*—Robin Hylton
(74) *Attorney, Agent, or Firm*—Michael A. O'Neil

(57) ABSTRACT

A bulk bag for dense materials includes side panels seamed together to form side walls having first and second ends and at least one end wall secured to the first ends of the side walls with the seams connecting the side panels to form the side walls located at points substantially spaced from the adjacent corners of the end wall. Four baffles extend across the corners of the end wall and are secured to the side panels. One or more additional baffles are secured in the side wall seams and extend entirely across the interior of the bulk bag to maintain the bulk bag in a rectangular cross-sectional configuration when filled with dense materials.

5 Claims, 6 Drawing Sheets

BULK BAG FOR DENSE MATERIALS

TECHNICAL FIELD

The present invention relates generally to flexible intermediate bulk containers, also known as bulk bags, and more particularly to an improved bulk bag construction useful in the transportation, storage, and discharge of dense materials.

BACKGROUND OF THE INVENTION

Over the past three decades flexible intermediate bulk containers, commonly known as bulk bags, have gained increasing acceptance in the transportation, storage, and discharge of dry, flowable solids. Bulk bags are almost universally constructed from woven polypropylene panels which are joined along their adjacent edges by sewing. Although tubular bulk bag constructions are known, most of the present bulk bag designs are square or rectangular in horizontal cross section.

Because they are constructed from flexible fabrics, conventional bulk bag designs assume a cylindrical configuration when filled regardless of their original horizontal cross-sectional configuration. This is undesirable because cylindrical configurations cannot completely fill a square or rectangular vehicle or warehouse.

The foregoing problem is overcome by the bulk bag disclosed and claimed in Derby U.S. Pat. No. 5,076,710 issued Dec. 31, 1991, and assigned to the assignee hereof. As illustrated in FIGS. 1 and 2 hereof, the bulk bag of the Derby Patent employs side panels which are joined at seams located at spaced intervals relative to the corners of the bulk bag. Baffles extending across the corners of the bulk bag and secured to the side panels prevent the bulk bag from assuming a cylindrical configuration when filled.

The bulk bag of the Derby Patent operates satisfactorily when used in conjunction with relatively light materials. However, when used in conjunction with more dense materials, the bulk bag construction of the Derby invention is not entirely successful in maintaining a rectangular configuration when filled. Thus, a need exists for further improvements in the art of bulk bag design to provide a bulk bag which maintains a rectangular configuration even when filled with coins and other objects formed from relatively heavy metals.

The present invention comprises a bulk bag construction which fulfills the foregoing and other objectives long since found lacking in the prior art. In accordance with the broader aspects of the invention, a bulk bag constructed generally in accordance with the disclosure of the above-identified Derby Patent is provided with at least one additional panel extending between the side walls of the bulk bag. The use of the additional panel in the construction of the bulk bag prevents the side walls of the bulk bag from bulging outwardly when the bulk bag is filled with dense materials.

In accordance with more specific aspects of the invention, the bulk bag may be provided with either one or two panels extending between the side walls thereof. When two panels are used, the panels may be deployed either in a parallel configuration or in a perpendicular configuration.

BRIEF DESCRIPTION OF THE DRAWINGS

A more complete understanding of the present invention may be had by reference to the following Detailed Description when taken in connection with the accompanying Drawings wherein.

DETAILED DESCRIPTION

Figure 1:
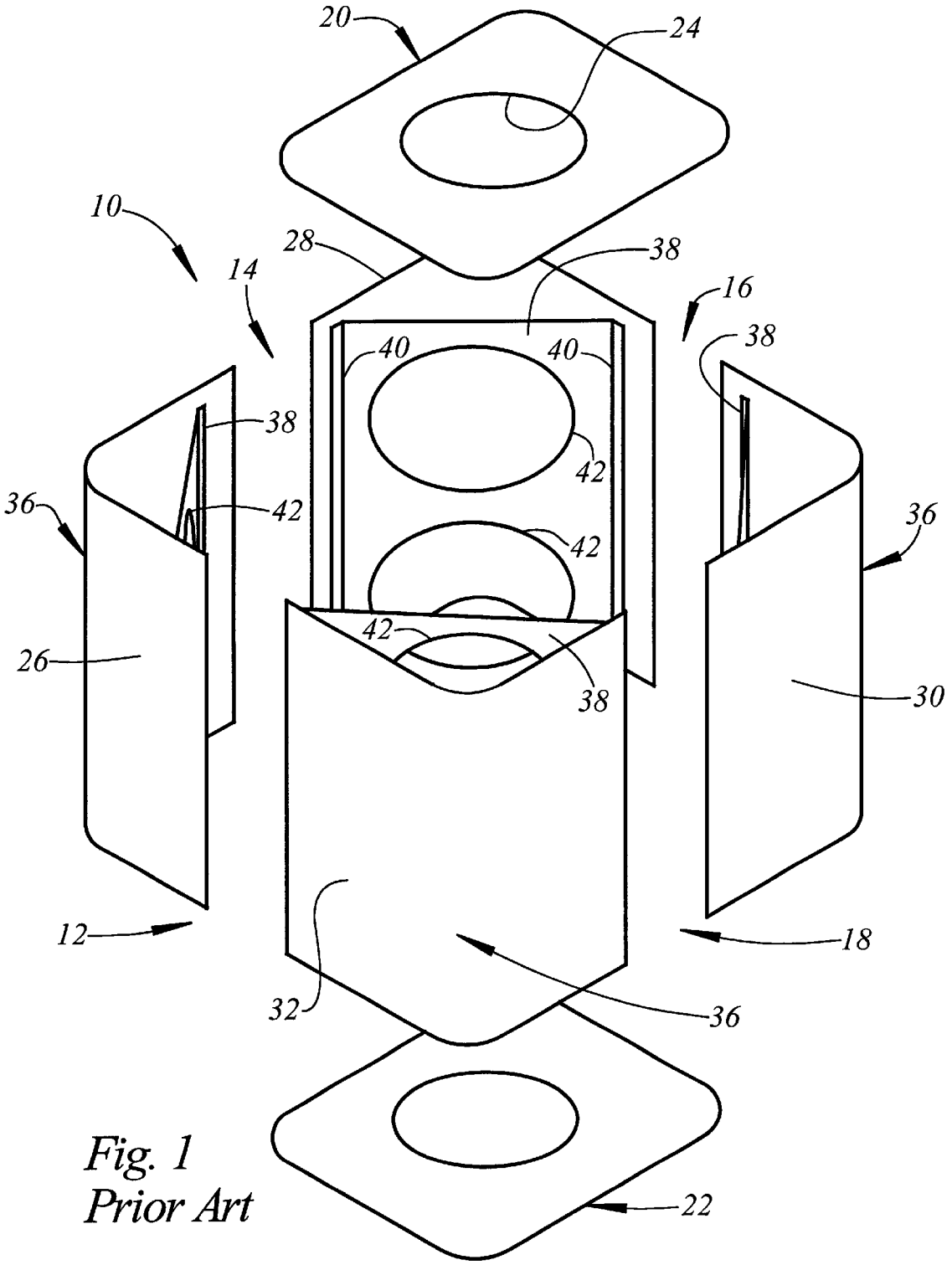
Fig. 1 Prior Art
FIG. 1 is an exploded perspective view of a prior art bulk bag.
Figure 2:
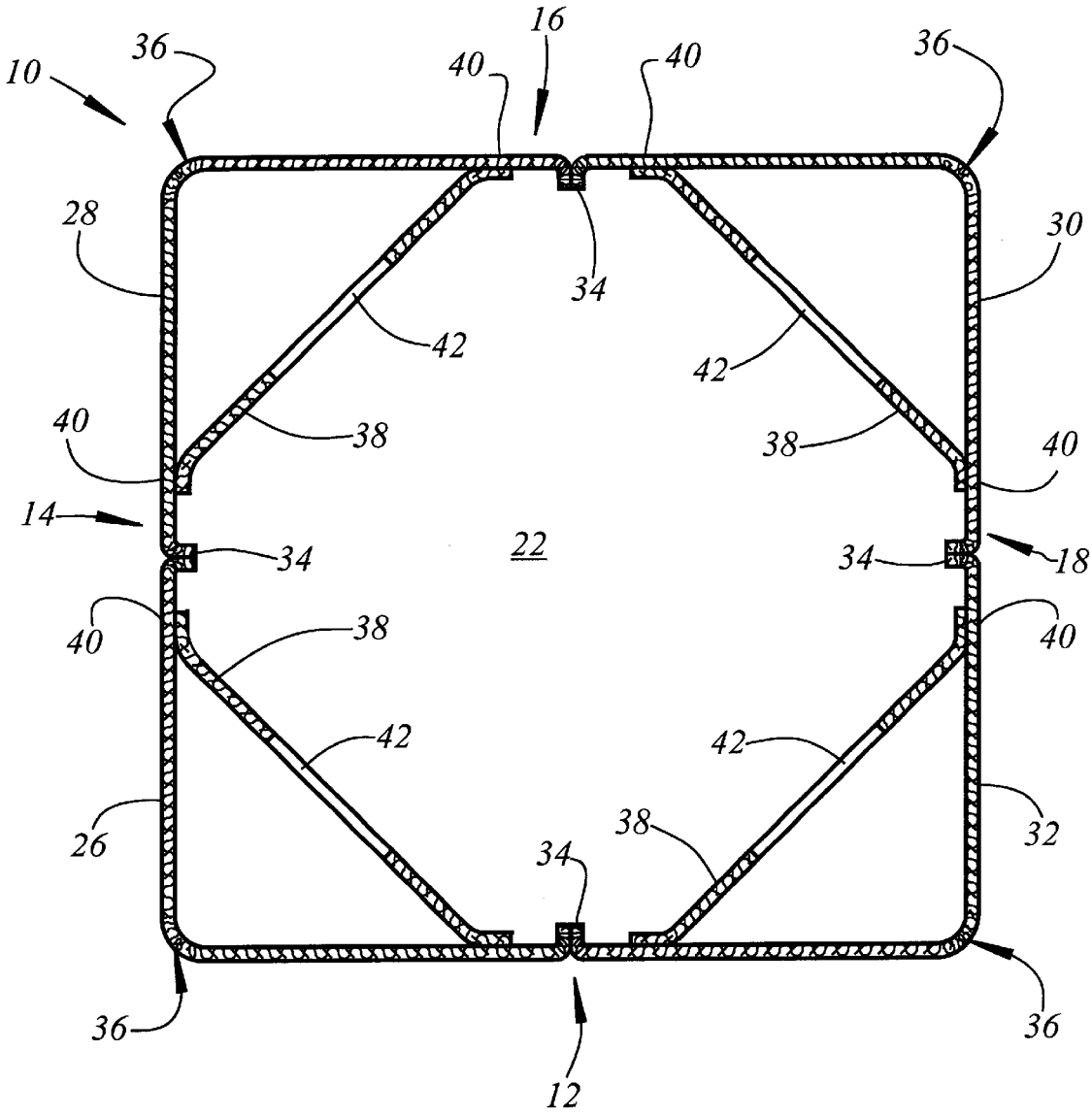
Fig. 2 Prior Art
FIG. 2 is a horizontal sectional view of the bulk bag of FIG. 1.

Referring now to the Drawings, and particularly to FIGS. 1 and 2 thereof, there is shown a bulk bag 10 constructed in accordance with the teachings of Derby U.S. Pat. No. 5,076,710 granted Dec. 31, 1991, and assigned to the assignee hereof. The bulk bag 10 includes four side walls 12, 14, 16, and 18. The bulk bag 10 further includes a top wall 20 and a bottom wall 22 either of which may be provided with an aperture 24 which receives a fill spout in the case of the top wall 20 or a discharge spout in the case of the bottom wall 22.

The side walls 12, 14, 16, and 18 of the bulk bag 10 are formed from four side panels 26, 28, 30, and 32. The side panels 26, 28, 30, and 32 are joined one to another at seams 34 each of which is located in a spaced apart relationship to the corners 36 of the bulk bag 10. In the embodiment of the Derby invention illustrated in FIG. 2, the seams 34 are located at points equidistant from adjacent corners 36, however, other configurations can be used in the practice of the Derby invention, if desired.

Each of the side panels 26, 28, 30, and 32 is provided with a baffle 38. Each baffle 38 is secured to its respective side panel at points 40 by sewing. Each baffle 38 is provided with one or more apertures 42 which allow material received in the bulk bag to flow into the corners 36 thereof.

Figure 3:
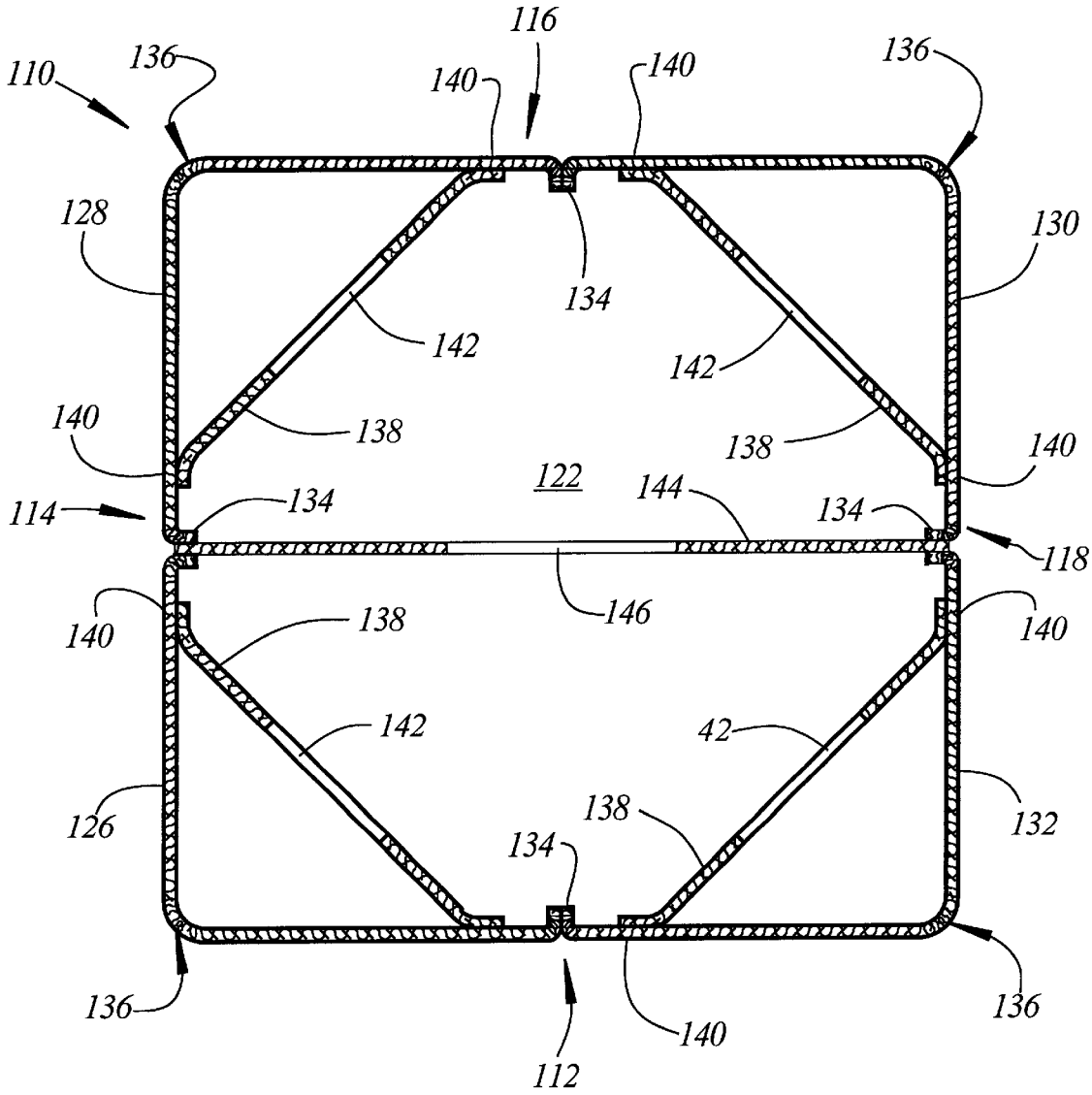
FIG. 3 is a horizontal sectional view of a bulk bag comprising the first embodiment of the present invention.

Referring now to FIG. 3, there is shown a bulk bag 110 comprising a first embodiment of the present invention. The bulk bag 110 includes four side walls 112, 114, 116, and 118. The bulk bag 110 further includes a bottom wall 122 and may include a top wall, although open top bulk bags are known. The top wall and the bottom wall may be provided with an aperture which receives a fill spout in the case of the top wall or a discharge spout in the case of the bottom wall.

The side walls 112, 114, 116, and 118 of the bulk bag 110 are formed from four side panels 126, 128, 130, and 132. The side panels 126, 128, 130, and 132 are joined one to another at seams 134 each of which is located in a spaced apart relationship to the corners 136 of the bulk bag 110. In the embodiment of the invention illustrated in FIG. 3, the seams 134 are located at points equidistant from adjacent corners 136, however, other configurations can be used in the practice of the invention, if desired.

Each of the side panels 126, 128, 130, and 132 is provided with a baffle 138. Each baffle 138 is secured to its respective side panel at points 140 by sewing. Each baffle 138 is provided with one or more apertures 142 which allow material received in the bulk bag to flow into the corners 136 thereof.

In accordance with the present invention, the bulk bag 110 is provided with a baffle 144 which extends between the seams 134 of the side walls 114 and 118. The baffle 144 is provided with an aperture 146 which allows material to flow between the opposite sides of the baffle 144 as the bulk bag 110 is filled. The baffle 144 prevents the side walls 114 and 118 of the bulk bag 110 from bulging outwardly when the bulk bag 110 is filled with dense materials, thereby preventing the bulk bag 110 from assuming a non-rectangular configuration when filled.

Figure 4:
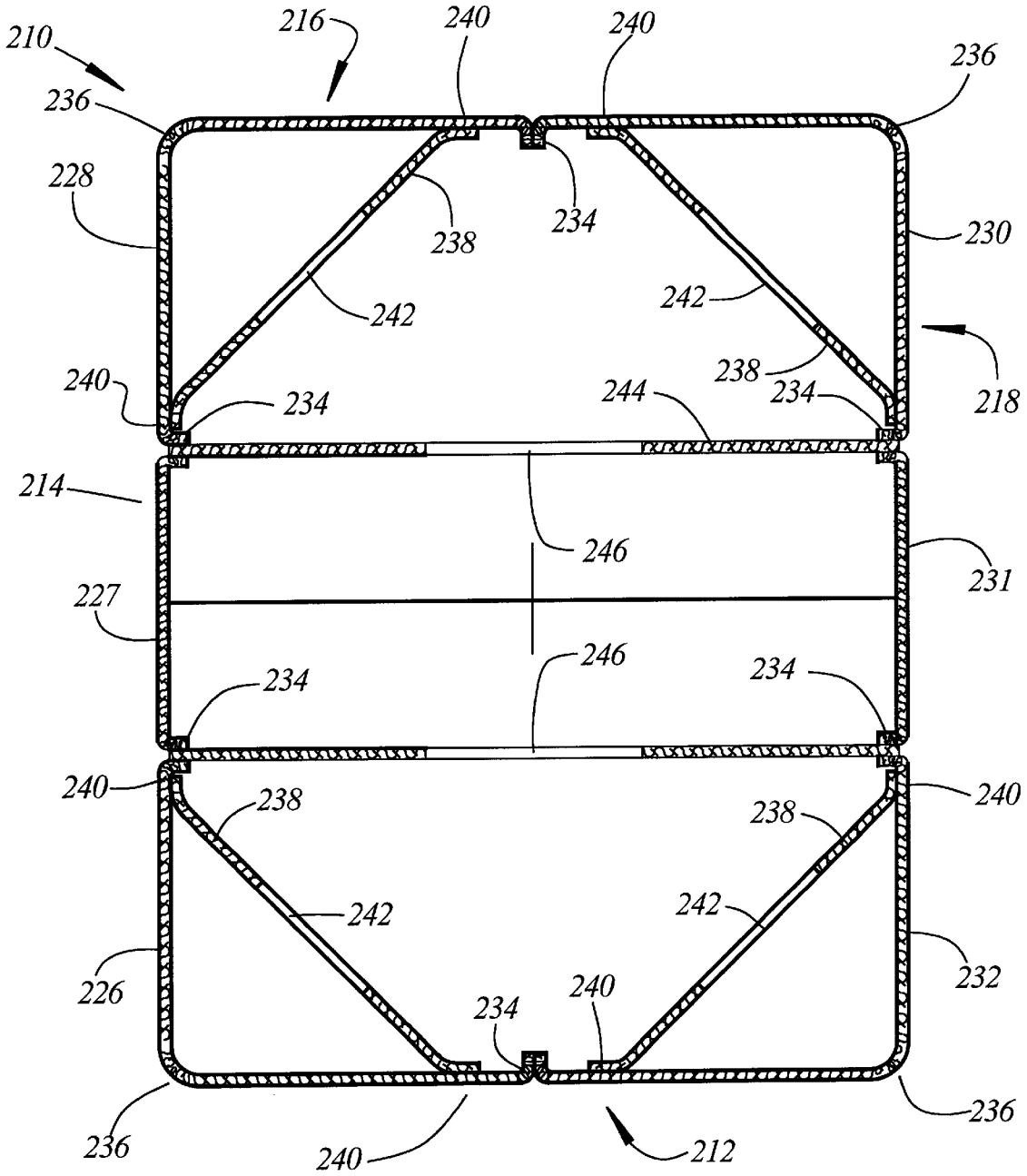
FIG. 4 is a horizontal sectional view of a bulk bag comprising a second embodiment of the present invention.

Referring now to FIG. 4, there is shown a bulk bag 210 comprising a second embodiment of the present invention. The bulk bag 210 includes four side walls 212, 214, 216, and 218. The bulk bag 210 further includes a top wall and a bottom wall 222 either of which may be provided with an aperture which receives a fill spout in the case of the top wall or a discharge spout in the case of the bottom wall.

The side walls 212, 214, 216, and 218 of the bulk bag 210 are formed from six side panels 226, 227, 228, 230, 231, and 232. The side panels 226, 227, 228, 230, 231, and 232 are joined one to another at seams 234 each of which is located in a spaced apart relationship to the corners 236 of the bulk bag 210. In the embodiment of the invention illustrated in FIG. 4, the side walls 214 and 218 which include the panels 227 and 231, respectively, are relatively longer than the side walls 212 and 216.

Each of the side panels 226, 228, 230, and 232 is provided with a baffle 238. Each baffle 238 is secured to its respective side panel at points 240 by sewing. Each baffle 238 is provided with one or more apertures 242 which allow material received in the bulk bag t o flow into the corners 236 thereof.

In accordance with the present invention, the bulk bag 210 is provided with two baffles 244 which are secured in and extend between the seams 234 of the side walls 214 and 218. The baffles 244 are provided with apertures 246 which allow material to flow between the opposite sides of the baffles 244 as the bulk bag 210 is filled. The baffles 244 prevent the side walls 214 and 218 of the bulk bag 210 from bulging outwardly when the bulk bag 210 is filled with dense materials, thereby preventing the bulk bag 110 from assuming a non-rectangular configuration when filled.

Figure 5:
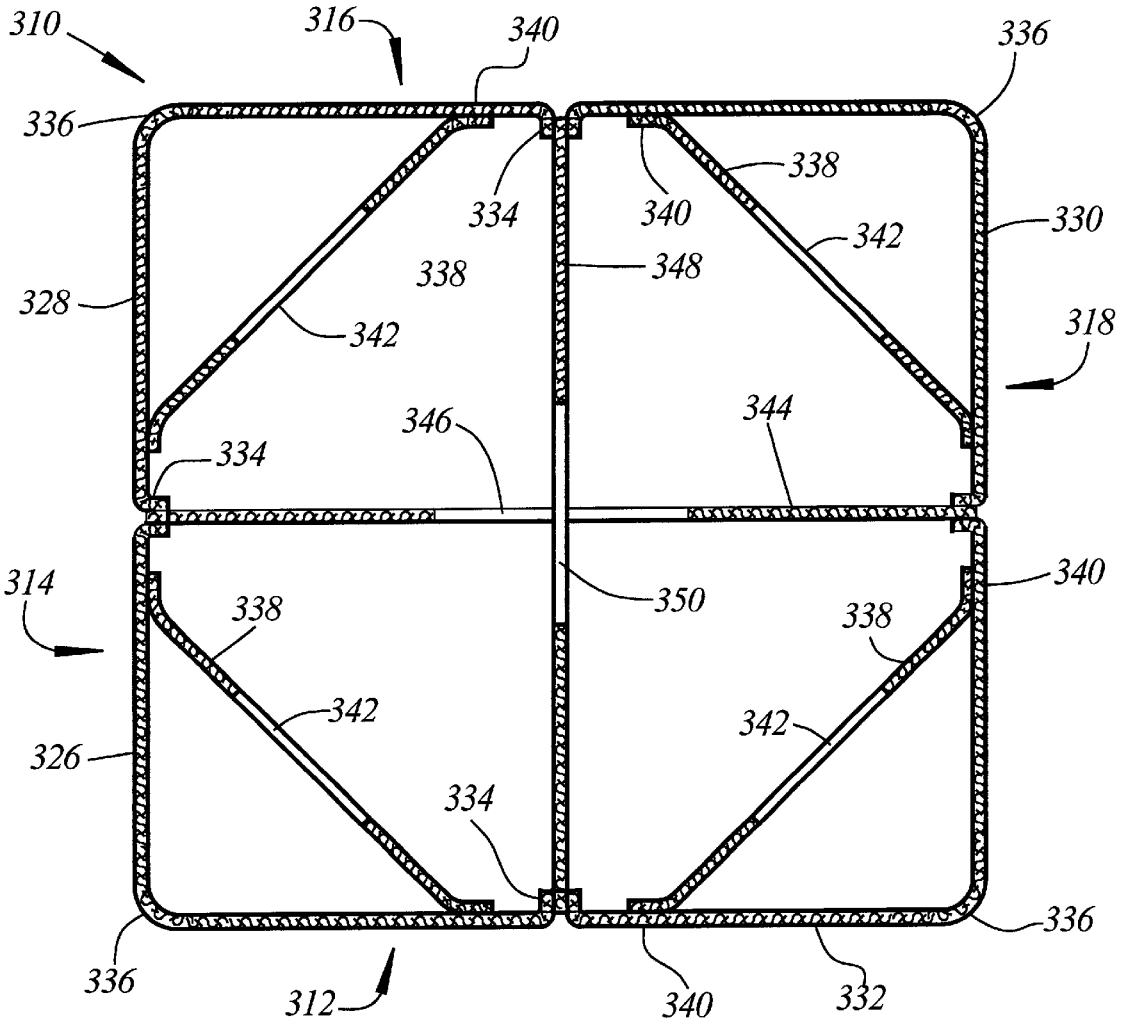
FIG. 5 is a horizontal sectional view of a bulk bag comprising a third embodiment of the present invention.
Figure 6:
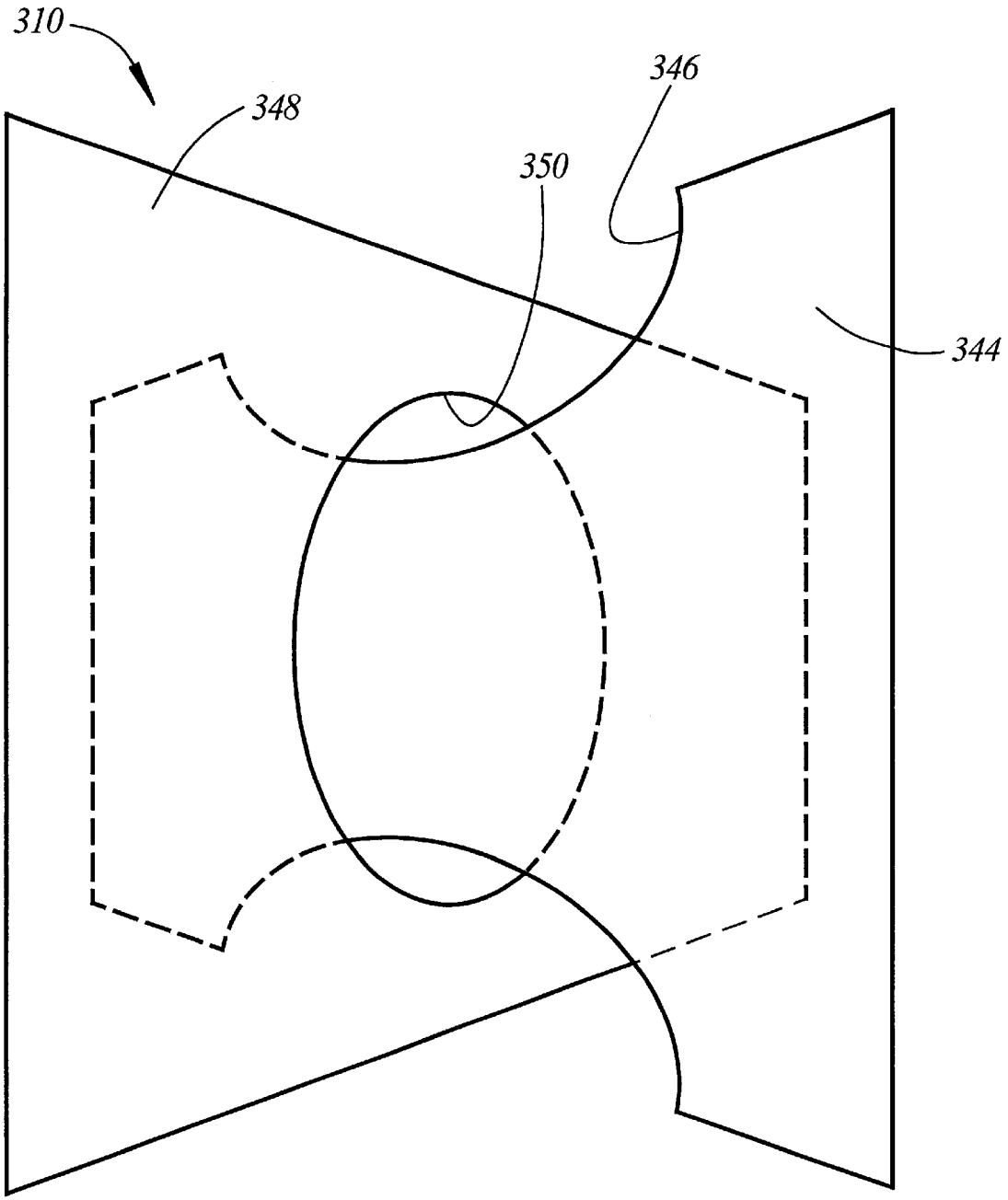
FIG. 6 is a further illustration of the bulk bag of FIG. 5.

Referring to FIGS. 5 and 6, there is shown a bulk bag 310 comprising a third embodiment of the present invention. The bulk bag 310 includes four side walls 312, 314, 316, and 318. The bulk bag 310 further includes a top wall and a bottom wall 322 either of which may be provided with an aperture which receives a fill spout in the case of the top wall or a discharge spout in the case of the bottom wall.

The side walls 312, 314, 316, and 318 of the bulk bag 310 are formed from four side panels 326, 328, 330, and 332. The side panels 326, 328, 330, and 332 are joined one to another at seams 334 each of which is located in a spaced apart relationship to the corners 336 of the bulk bag 310. In the embodiment of the invention illustrated in FIG. 5, the seams 334 are located at points equidistant from adjacent corners 336, however, other configurations can be used in the practice of the invention, if desired.

Each of the side panels 326, 328, 330, and 332 is provided with a baffle 338. Each baffle 338 is secured to its respective side panel at points 340 by sewing. Each baffle 338 is provided with one or more apertures 342 which allow material received in the bulk bag to flow into the corners 336 thereof.

The bulk bag 310 includes a baffle 344 which is sewn into the seams 334 on opposite sides of the bulk bag and extends between the side walls 214 and 218. A baffle 348 is likewise sewn into the seams 334 and extends between the side wall 212 and the side wall 216. As is best shown in FIG. 6, the baffle 344 has an aperture 346 centrally located therein, and the baffle 348 has apertures 350 formed in the upper and lower edges thereof. This allows the baffle 348 to extend through the baffle 344.

In the use of the bulk bag 310, the baffle 344 prevents the side walls 314 and 318 from bulging outwardly when the bulk bag is filled with dense materials. Likewise, the baffle 348 prevents the side walls 312 and 316 from bulging outwardly when the bulk bag is formed with dense materials. In this manner the baffle 344 and 348 maintain the bulk bag 310 in a square or rectangular configuration when the bulk bag is filled with dense materials.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A bulk bag for dense materials comprising:

four side panels each seamed to at least one adjacent side panel to form four side walls having first and second ends and defining an interior area substantially rectangular in shape;

at least one end wall having four corners and seamed to the first ends of the side walls with the seams connecting the side panels to form the side walls located at points substantially spaced from the adjacent corners of the end wall;

four baffles each extending diagonally across one of the corners of the end wall and having opposite ends each seamed to one of the side panels; and a pair of additional baffles extending in parallel entirely across the end wall and having opposite ends seamed to opposite side walls of the bulk bag.

2. The bulk bag for dense materials according to claim 1 wherein the opposite ends of each of the additional baffles is secured in one of the seams defining one of the opposite side walls of the bulk bag.

3. A bulk bag for dense materials comprising four side panels each seamed to an adjacent side panel to form four side walls having first and second ends and defining an interior substantially rectangular in shape;

at least one end wall having four corners and seamed to the first ends of the side walls with the seams connecting the side panels to form the side walls located at points substantially spaced from the adjacent corners of the end wall;

four baffles each extending diagonally across one of the corners of the end wall and having opposite ends each seamed to one of the side panels;

two additional baffles disposed parallel to one another and each having opposite ends secured in side wall seams located on opposite sides of the end wall; and the four baffles and the two additional baffles each having apertures formed therein to permit the passage of material therethrough.

4. A bulk bag for dense materials comprising:

four side panels each seamed to an adjacent side panel to form four side walls having first and second ends and defining an interior substantially rectangular in shape;

at least one end wall having four corners and seamed to the first ends of the side walls with the seams connecting the side panels to form the side walls located at points spaced substantially equi-distant from the adjacent corners of the end wall;

four baffles each extending diagonally across one of the corners of the end wall and having opposite ends each seamed to one of the side panels;

an additional baffle having opposite ends secured in side wall seams located on opposite sides of the end wall and extending entirely across the end wall; and the four baffles and the additional baffle each having apertures formed therein to permit the passage of material therethrough;

the four side panels each having a diagonally extending baffle secured thereto are arranged in pairs at opposite ends of the end walls with the pairs being separated by two additional side panels thereby defining a relatively long, relatively narrow bulk bag.

5. A bulk bag for dense materials comprising;

four side panels each seamed to at least one adjacent side panel to form four side walls having first and second ends and defining an interior area substantially rectangular in shape;

at least one end wall having four corners and seamed to the first ends of the side walls with the seams connecting the side panels to form the side walls located at points substantially spaced from the adjacent corners of the end walls;

four baffles each extending diagonally across one of the corners of the end wall and having opposite ends each seamed to one of the side panels;

two additional baffles disposed perpendicularly to one another and each having opposite ends secured in one of the side wall seams; and one of the additional baffles having an aperture formed therein with the other additional baffle extending through the aperture.

* * * * *